US008019255B2

(12) United States Patent
Dobbertin et al.

(10) Patent No.: US 8,019,255 B2
(45) Date of Patent: Sep. 13, 2011

(54) ALIGNMENT METHOD FOR A PLURALITY OF COUPLED DIGITAL PRINT ENGINES

(75) Inventors: Michael T. Dobbertin, Honeoye, NY (US); Alan E. Rapkin, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 15 days.

(21) Appl. No.: 12/491,630

(22) Filed: Jun. 25, 2009

(65) Prior Publication Data

US 2010/0329740 A1 Dec. 30, 2010

(51) Int. Cl.
*G03G 15/00* (2006.01)

(52) U.S. Cl. ..... 399/126; 399/394; 399/395

(58) Field of Classification Search ..... 399/49, 399/72, 107, 126, 391, 394, 395
See application file for complete search history.

(56) References Cited

U.S. PATENT DOCUMENTS

| | | | | |
|---|---|---|---|---|
| 6,144,024 | A | 11/2000 | Rushing | |
| 6,222,176 | B1 | 4/2001 | Rushing et al. | |
| 6,225,618 | B1 | 5/2001 | Rushing et al. | |
| 6,229,972 | B1 | 5/2001 | Rushing | |
| 6,331,832 | B1 | 12/2001 | Rushing | |
| 6,567,171 | B1 | 5/2003 | Rushing | |
| 6,671,052 | B1 | 12/2003 | Rushing | |
| 6,791,485 | B1 | 9/2004 | Rushing | |
| 6,968,606 | B2 | 11/2005 | Fromm et al. | |
| 7,245,856 | B2 | 7/2007 | Furst et al. | |
| 7,272,334 | B2 * | 9/2007 | Moore et al. | 399/72 |
| 2004/0094492 | A1 | 5/2004 | Greenwald et al. | |
| 2004/0253031 | A1 | 12/2004 | Okazaki | |
| 2005/0044713 | A1 | 3/2005 | Fromm et al. | |
| 2006/0222384 | A1 | 10/2006 | Moore et al. | |
| 2006/0233569 | A1 | 10/2006 | Furst et al. | |

* cited by examiner

*Primary Examiner* — Hoang Ngo
(74) *Attorney, Agent, or Firm* — Donna P. Suchy

(57) ABSTRACT

The adjustment method aligns printing engines in a print assembly that is capable of printing on a receiver to form one or more final prints and includes corrections for cross-track misregistration. These adjustments are made in one embodiment by aligning two or more printing engines in an x and y direction relative to a receiver reference and then aligning each printing engines in a cross track direction (z direction) relative to the receiver reference based on measurements in the cross track direction (z direction).

20 Claims, 8 Drawing Sheets

ALIGNMENT METHOD FOR A PLURALITY OF COUPLED DIGITAL PRINT ENGINES

FIELD OF THE INVENTION

This invention relates to a printing system comprising a plurality of print engines, at least one of which is a digital print engine using electrophotographic technology.

BACKGROUND OF THE INVENTION

In typical commercial reproduction apparatus (electrographic copier/duplicators, printers, or the like), a latent image charge pattern is formed on a primary imaging member (PIM) such as a photoreceptor used in an electrophotographic printing apparatus. While the latent image can be formed on a dielectric PIM by depositing charge directly corresponding to the latent image, it is more common to first uniformly charge a photoreceptive PIM member. The latent image is then formed by area-wise exposing the PIM in a manner corresponding to the image to be printed. The latent image is rendered visible by bringing the primary imaging member into close proximity to a development station. A typical development station may include a cylindrical magnetic core and a coaxial nonmagnetic shell. In addition, a sump may be present containing developer which includes marking particles, typically including a colorant such as a pigment, a thermoplastic binder, one or more charge control agents, and flow and transfer aids such as submicrometer particles adhered to the surface of the marking particles. The submicrometer particles typically include silica, titania, various lattices, etc. The developer also typically includes magnetic carrier particles such as ferrite particles that tribocharge the marking particles and transport the marking particles into close proximity to the PIM, thereby allowing the marking particles to be attracted to the electrostatic charge pattern corresponding to the latent image on the PIM, thereby rendering the latent image into a visible image.

The shell of the development station is typically electrically conducting and can be electrically biased so as to establish a desired difference of potential between the shell and the PIM. This, together with the electrical charge on the marking particles, determines the maximum density of the developed print for a given type of marking particle.

The image developed onto the PIM member is then transferred to a suitable receiver such as paper or other substrate. This is generally accomplished by pressing the receiver into contact with the PIM member while applying a potential difference (voltage) to urge the marking particles towards the receiver. Alternatively, the image can be transferred from the primary imaging member to a transfer intermediate member (TIM) and then from the TIM to the receiver.

The image is then fixed to the receiver by fusing, typically accomplished by subjecting the image bearing receiver to a combination of heat and pressure. The PIM and TIM, if used, are cleaned and made ready for the formation of another print.

A printing engine generally is designed to generate a specific number of prints per minute. For example, a printer may be able to generate 150 single-sided pages per minute (ppm) or approximately 75 double-sided pages per minute with an appropriate duplexing technology. Small upgrades in system throughput may be achievable in robust printing systems. However, the doubling of throughput speed is mainly unachievable without a) purchasing a second reproduction apparatus with throughput identical to the first so that the two machines may be run in parallel, or without b) replacing the first reproduction apparatus with a radically redesigned print engine having double the speed. Both options are very expensive and often with regard to option (b), not possible.

Another option for increasing printing engine throughput is to utilize a second print engine in series with a first print engine. For example, U.S. Pat. No. 7,245,856 discloses a tandem print engine assembly which is configured to reduce image registration errors between a first side image formed by a first print engine, and a second side image formed by a second print engine. Each of the '856 print engines has a seamed photoreceptive belt. The seams of the photoreceptive belt in each print engine are synchronized by tracking a phase difference between seam signals from both belts. Synchronization of a slave print engine to a main print engine occurs once per revolution of the belts, as triggered by a belt seam signal, and the speed of the slave photoreceptor and the speed of an imager motor and polygon assembly are updated to match the speed of the master photoreceptor. Unfortunately, such a system tends to be susceptible to increasing registration errors during each successive image frame during the photoreceptor revolution. Furthermore, given the large inertia of the high-speed rotating polygon assembly, it is difficult to make significant adjustments to the speed of the polygon assembly in the relatively short time frame of a single photoreceptor revolution. This can limit the response of the '856 system on a per revolution basis, and make it even more difficult, if not impossible, to adjust on a more frequent basis.

Color images are made by printing separate images corresponding to an image of a specific color. The separate images are then transferred, in register, to the receiver. Alternatively, they can be transferred in register to a TIM and from the TIM to the receiver or they may be transferred separately to a TIM and then transferred and registered on the receiver. For example, a printing engine assembly capable of producing full color images may include at least four separate print engines or modules where each module or engine prints one color corresponding to the subtractive primary color cyan, magenta, yellow, and black. Additional development modules may include marking particles of additional colorants to expand the obtainable color gamut, clear toner, etc., as are known in the art. The quality of images produced on different print engines can be found to be objectionable if produced on different print engines even if the print engines are nominally the same, e.g. the same model produced by the same manufacturer. For example, the images can have slightly different sizes, densities or contrasts. These variations, even if small, can be quite noticeable if the images are compared closely.

It is clearly important that certain image quality attributes, including size, print density, and contrast, match for prints made on separate print engines if those prints are subject to close scrutiny, as would be the case when a print made on a receiver sheet is produced on separate print engines. Specifically, the reflection density and the contrast of the prints need to closely match or the prints will be found to be objectionable to a customer. Even prints produced on two nominally identical digital printing presses such as electrophotographic printing presses described herein can vary in density and contrast due to variations in the photo-response of the PIM, variations in the charge or size of the marking particles, colorant dispersion variations within the batches of marking particles used in the separate engines, etc. It is clear that a method is needed to allow comparable prints to be produced on a plurality of engines.

SUMMARY OF THE INVENTION

According to this invention, an adjustment method aligns printing engines in a print assembly that is capable of printing on a receiver to form one or more final prints and includes corrections for cross-track misregistration. These adjustments are made in one embodiment by aligning two or more printing engines in a cross track direction (z direction) relative to the receiver expected and actual positions. Alignment pins and holes are then located to correctly horizontally align the components and additional spacers are installed to allow the modules to be aligned vertically. It is preferred that the positions of the alignment pins and/or holes can be adjusted so that the digital print engine can be realigned when necessary such as when components are changed.

Figure 1:
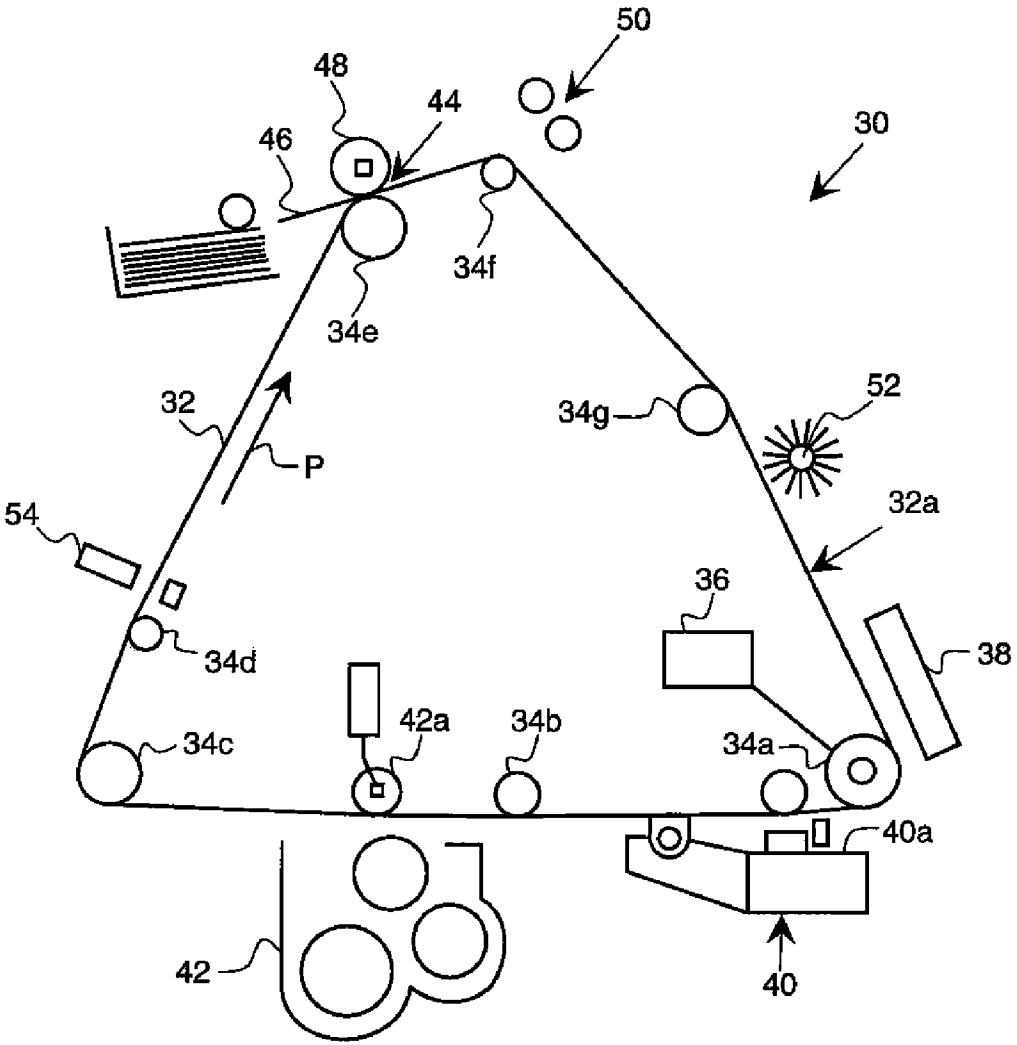
FIG. 1 schematically illustrates an embodiment of an electrophotographic print engine.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION OF THE INVENTION

FIG. 1 schematically illustrates an embodiment of an electrophotographic print engine 30. The print engine 30 has a movable recording member such as a photoreceptive belt 32, which is entrained about a plurality of rollers or other supports 34*a* through 34*g*. The photoreceptive belt 32 may be more generally referred-to as a primary imaging member (PIM 32. A primary imaging member (PIM) 32 may be any charge carrying substrate which may be selectively charged or discharged by a variety of methods including, but not limited to corona charging/discharging, gated corona charging/discharging, charge roller charging/discharging, ion writer charging, light discharging, heat discharging, and time discharging.

One or more of the rollers 34*a*-34*g* are driven by a motor 36 to advance the PIM 32. Motor 36 preferably advances the PIM 32 at a high speed, such as 20 inches per second or higher, in the direction indicated by arrow P, past a series of workstations of the print engine 30, although other operating speeds may be used, depending on the embodiment. In some embodiments, PIM 32 may be wrapped and secured about a single drum. In further embodiments, PIM 32 may be coated onto or integral with a drum.

It is useful to define a few terms that are used in relation to this invention. Optical density is the log of the ratio of the intensity of the input illumination to the transmitted, reflected, or scattered light, or $D=\log(I_i/I_o)$ where D is the optical density, $I_1$ is the intensity of the input illumination, $I_o$ is the intensity of the output illumination, and log is the logarithm to the base 10. Thus, an optical density of 0.3 means that the output intensity is approximately half of the input intensity which is desirable for quality prints.

For some applications, it is preferable to measure the intensity of the light transmitted through a sample such as a printed image. This is referred to as the transmission density and is measured by first nulling out the density of the substrate supporting the image and then measuring the density of the chosen region of the image by illuminating the image through the back of the substrate with a known intensity of light and measuring the intensity of the light transmitted through the sample. The color of the light chosen corresponds to the color of the light principally absorbed by the sample. For example, if the sample consists of a printed black region, white light would be used. If the sample was printed using the subtractive primary colors (cyan, magenta, or yellow), red, green, or blue light, respectively, would be used.

Alternatively, it is sometimes preferable to measure the light reflected or scattered from a sample such as a printed image. This is referred to as the reflection density. This is accomplished by measuring the intensity of the light reflected from a sample such as a printed image after nulling out the reflection density of the support. The color of the light chosen corresponds to the color of the light principally absorbed by the sample. For example, if the sample consists of a printed black region, white light would be used. If the sample was printed using the subtractive primary colors (cyan, magenta, or yellow), cyan, magenta, or yellow light, respectively, would be used.

A suitable device for measuring optical density is an X-Rite densitometer with status A filters. Some such devices measure either transmission or reflected light. Other devices measure both transmission and/or reflection densities. Alternatively, for use within a printing engine, densitometers such as those described by Rushing in U.S. Pat. Nos. 6,567,171, 6,144,024, 6,222,176, 6,225,618, 6,229,972, 6,331,832, 6,671,052, and 6,791,485 are well suited. Other densitometers, as are known in the art, are also suitable.

The size of the sample area required for densitometry measurements varies, depending on a number of factors such as the size of the aperture of the densitometer and the information desired. For example, microdensitomers are used to measure site-to-site variations in density of an image on a very small scale to allow the granularity of an image to be measured by determining the standard deviation of the density of an area having a nominally uniform density. Alternatively, densitometers also are used having an aperture area of several square centimeters. These allow low frequency variations in density to be determined using a single measurement. This allows image mottle to be determined. For simple determinations of image density, the area to be measured generally has a radius of at least 1 mm but not more than 5 mm.

The term module means a device or subsystem designed to perform a specific task in producing a printed image. For example, a development module in an electrophotographic printer would include a primary imaging member (PIM) such as a photoreceptive member and one or more development stations that would image-wise deposit marking or toner particles onto an electrostatic latent image on the PIM, thereby rendering it into a visible image. A module can be an integral component in a print engine. For example, a development module is usually a component of a larger assembly that includes writing transfer and fuser modules such as are known in the art. Alternatively, a module can be self contained and can be made in a manner so that they are attached to other modules to produce a print engine. Examples of such modules include scanners, glossers, inverters that will invert a sheet of paper or other receiver to allow duplex printing, inserters that allow sheets such as covers or preprinted receivers to be inserted into documents being printed at specific locations within a stack of printed receiver sheets, and finishers that can fold, stable, glue, etc. the printed documents.

A print engine includes sufficient modules to produce prints. For example, a black and white electrophotographic print engine would generally include at least one development module, a writer module, and a fuser module. Scanner and finishing modules can also be included if called for by the intended applications.

A print engine assembly, also referred to in the literature as a reproduction apparatus, includes a plurality of print engines that have been integrally coupled together in a manner to allow them to print in a desired manner. For example, print engine assemblies that include two print engines and an inverter module that are coupled together to increase productivity by allowing the first print engine to print on one side of a receiver, the receiver then fed into the inverter module which inverts the receiver and feeds the receiver into the second print engine that prints on the inverse side of the receiver, thereby printing a duplex image.

A digital print engine is a print engine wherein the image is written using digital electronics. Such print engines allow the image to be manipulated, image by image, thereby allowing each image to be changed. In contrast, an offset press relies on the image being printed using press plates. Once the press plate is made, it cannot be changed. An example of a digital print engine is an electrophotographic print engine wherein the electrostatic latent image is formed on the PIM by exposing the PIM using a laser scanner or LED array. Conversely, an electrophotographic apparatus that relies on forming a latent image by using a flash exposure to copy an original document would not be considered a digital print engine.

A digital print engine assembly is a print engine assembly that a plurality of print engines of which at least one is a digital print engine. According to this invention, the alignment of printing engines and other printing modules in a printing assembly often must be held to better than 0.125". Although precise manufacturing of the individual modules making up the digital print engine can be made, this is difficult and expensive to achieve when multiple modules are coupled together to form the digital print engine. This difficulty becomes quite impossible when retrofitting or augmenting the capabilities of digital print engines already in the field. In this invention, alignment of the individual modules is achieved by first measuring the location of specific components with a module. Alignment pins and holes are then located to correctly horizontally align the components. In addition, spacers are installed that allow the modules to be aligned vertically. It is preferred that the positions of the alignment pins and/or holes can be adjusted so that the digital print engine can be realigned when necessary such as when components are changed.

Contrast is defined as the maximum value of the slope curve of the density versus log of the exposure. The contrast of two prints is considered to be equal if they differ by less than 0.2 ergs/cm$^2$ and preferably by less than 0.1 ergs/cm$^2$.

The print engine 30 may include a controller or logic and control unit (LCU) (not shown). The LCU may be a computer, microprocessor, application specific integrated circuit (ASIC), digital circuitry, analog circuitry, or a combination or plurality thereof. The controller (LCU) may be operated according to a stored program for actuating the workstations within print engine 30, effecting overall control of print engine 30 and its various subsystems. The LCU may also be programmed to provide closed-loop control of the print engine 30 in response to signals from various sensors and encoders. Aspects of process control are described in U.S. Pat. No. 6,121,986 incorporated herein by this reference.

A primary charging station 38 in print engine 30 sensitizes PIM 32 by applying a uniform electrostatic corona charge, from high-voltage charging wires at a predetermined primary voltage, to a surface 32*a* of PIM 32. The output of charging station 38 may be regulated by a programmable voltage controller (not shown), which may in turn be controlled by the LCU to adjust this primary voltage, for example by controlling the electrical potential of a grid and thus controlling movement of the corona charge. Other forms of chargers, including brush or roller chargers, may also be used.

An image writer, such as exposure station 40 in print engine 30, projects light from a writer 40*a* to PIM 32. This light selectively dissipates the electrostatic charge on photoreceptive PIM 32 to form a latent electrostatic image of the document to be copied or printed. Writer 40*a* is preferably constructed as an array of light emitting diodes (LEDs), or alternatively as another light source such as a Laser or spatial light modulator. Writer 40*a* exposes individual picture elements (pixels) of PIM 32 with light at a regulated intensity and exposure, in the manner described below. The exposing light discharges selected pixel locations of the photoreceptor, so that the pattern of localized voltages across the photoreceptor corresponds to the image to be printed. An image is a pattern of physical light, which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

After exposure, the portion of PIM 32 bearing the latent charge images travels to a development station 42. Development station 42 includes a magnetic brush in juxtaposition to the PIM 32. Magnetic brush development stations are well known in the art, and are desirable in many applications; alternatively, other known types of development stations or devices may be used. Plural development stations 42 may be provided for developing images in plural gray scales, colors, or from toners of different physical characteristics. Full process color electrographic printing is accomplished by utilizing this process for each of four toner colors (e.g., black, cyan, magenta, yellow).

Upon the imaged portion of PIM 32 reaching development station 42, the LCU selectively activates development station 42 to apply toner to PIM 32 by moving backup roller 42*a* and PIM 32, into engagement with or close proximity to the magnetic brush. Alternatively, the magnetic brush may be moved toward PIM 32 to selectively engage PIM 32. In either case, charged toner particles on the magnetic brush are selectively attracted to the latent image patterns present on PIM 32, developing those image patterns. As the exposed photoreceptor passes the developing station, toner is attracted to pixel locations of the photoreceptor and as a result, a pattern of toner corresponding to the image to be printed appears on the photoreceptor. As known in the art, conductor portions of development station 42, such as conductive applicator cylinders, are biased to act as electrodes. The electrodes are connected to a variable supply voltage, which is regulated by a programmable controller in response to the LCU, by way of which the development process is controlled.

Development station 42 may contain a two-component developer mix, which includes a dry mixture of toner and carrier particles. Typically the carrier preferably includes high coercivity (hard magnetic) ferrite particles. As a non-limiting example, the carrier particles may have a volume-weighted diameter of approximately 30μ. The dry toner particles are substantially smaller, on the order of 6μ to 15μ in volume-weighted diameter. Development station 42 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to PIM 32 to develop the electrostatic images thereon and the carrier material remains at development station 42. As toner is depleted from the development station due to the development of the electrostatic image, additional toner may be periodically introduced by a toner auger (not shown) into development station 42 to be mixed with the carrier particles to maintain a uniform amount of development mixture. This development mixture is controlled in accordance with various development control processes. Single component developer stations, as well as conventional liquid toner development stations, may also be used.

A transfer station 44 in printing machine 10 moves a receiver sheet 46 into engagement with the PIM 32, in registration with a developed image to transfer the developed image to receiver sheet 46. Receiver sheets 46 may be plain or coated paper, plastic, or another medium capable of being handled by the print engine 30. Typically, transfer station 44 includes a charging device for electrostatically biasing movement of the toner particles from PIM 32 to receiver sheet 46. In this example, the biasing device is roller 48, which engages the back of sheet 46 and which may be connected to a programmable voltage controller that operates in a constant current mode during transfer. Alternatively, an intermediate member may have the image transferred to it and the image may then be transferred to receiver sheet 46. After transfer of the toner image to receiver sheet 46, sheet 46 is detacked from PIM 32 and transported to fuser station 50 where the image is fixed onto sheet 46, typically by the application of heat and/or pressure. Alternatively, the image may be fixed to sheet 46 at the time of transfer. A cleaning station 52, such as a brush, blade, or web is also located beyond transfer station 44, and removes residual toner from PIM 32. A pre-clean charger (not shown) may be located before or at cleaning station 52 to assist in this cleaning. After cleaning, this portion of PIM 32 is then ready for recharging and re-exposure. Of course, other portions of PIM 32 are simultaneously located at the various workstations of print engine 30, so that the printing process may be carried out in a substantially continuous manner.

A controller provides overall control of the apparatus and its various subsystems with the assistance of one or more sensors, which may be used to gather control process, input data. One example of a sensor is belt position sensor 54.

Figure 2:
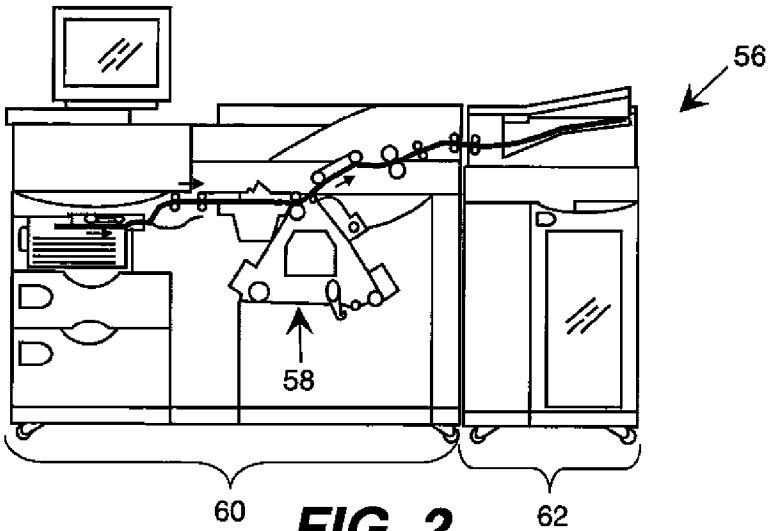
FIG. 2 schematically illustrates an embodiment of a reproduction apparatus having a first print engine.

FIG. 2 schematically illustrates an embodiment of a reproduction apparatus 56 having a first print engine 58 that is capable of printing one or a multiple of colors. The embodied reproduction apparatus will have a particular throughput, which may be measured in pages per minute (ppm). As explained above, it would be desirable to be able to significantly increase the throughput of such a reproduction apparatus 56 without having to purchase an entire second reproduction apparatus. It would also be desirable to increase the throughput of reproduction apparatus 56 without having to scrap apparatus 56 and replacing it with an entire new machine.

Quite often, reproduction apparatus 56 is made up of modular components. For example, the print engine 58 is housed within a main cabinet 60 that is coupled to a finishing unit 62. For simplicity, only a single finishing device 62 is shown, however, it should be understood that multiple finishing devices providing a variety of finishing functionality are known to those skilled in the art and may be used in place of a single finishing device. Depending on its configuration, the finishing device 62 may provide stapling, hole punching, trimming, cutting, slicing, stacking, paper insertion, collation, sorting, and binding.

Figure 3A:
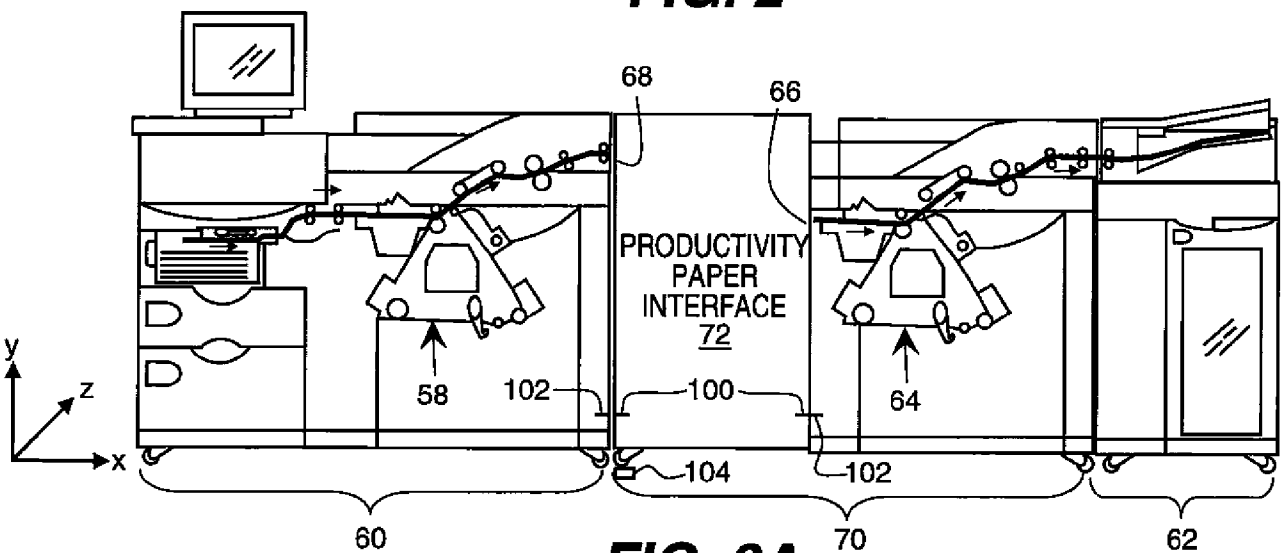
FIGS. 3A-3C schematically illustrate embodiments of a reproduction apparatus having a first print engine and a tandem second print engine from a productivity module.
Figure 3B:
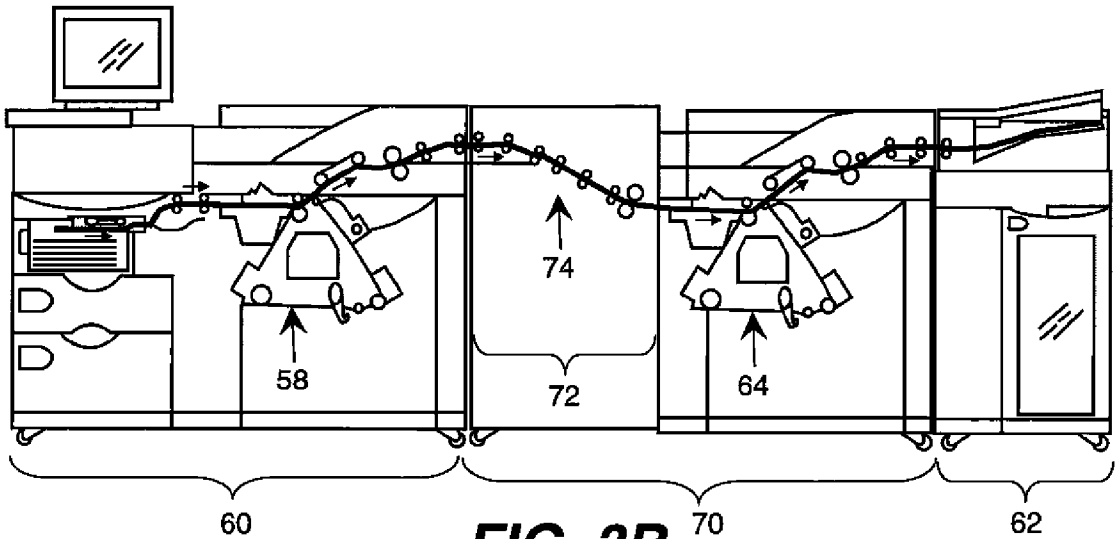
Figure 3C:
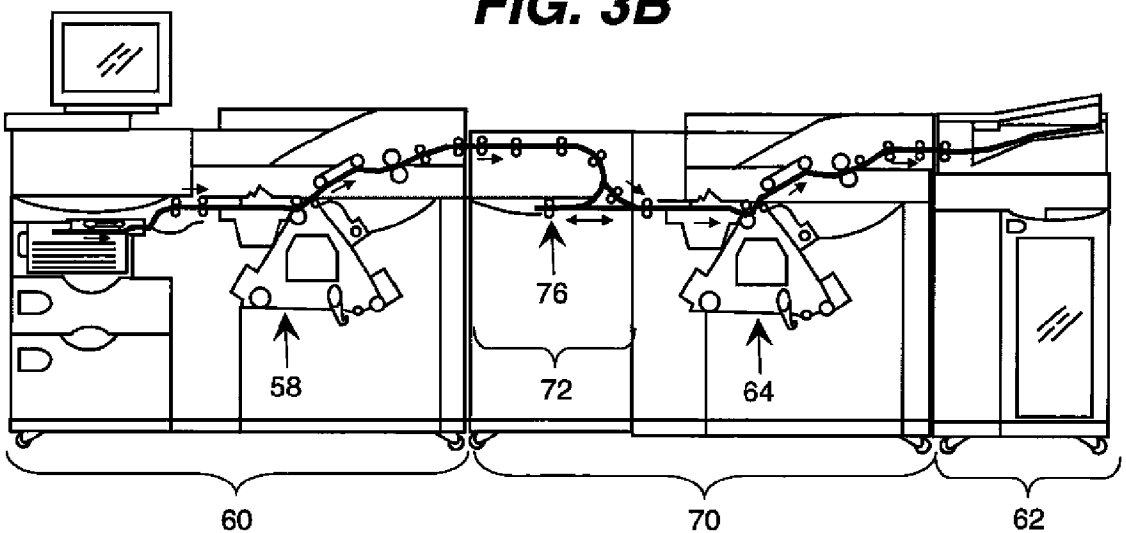

As FIG. 3A schematically illustrates, a second print engine 64 may be inserted in-line with the first print engine 58 and in-between the first print engine 58 and the finishing device 62 formerly coupled to the first print engine 58. The second print engine 64 may have an input paper path point 66 which does not align with the output paper path point 68 from the first print engine 58. Additionally, or optionally, it may be desirable to invert the receiver sheets from the first print engine 58 prior to running them through the second print engine (in the case of duplex prints). In such instances, the productivity module 70 which is inserted between the first print engine 58 and the at least one finisher 62 may have a productivity paper interface 72. Some embodiments of a productivity paper interface 72 may provide for matching 74 of differing output and input paper heights, as illustrated in the embodiment of FIG. 3B. Other embodiments of a productivity paper interface 72 may provide for inversion 76 of receiver sheets, as illustrated in the embodiment of FIG. 3C.

Providing users with the option to re-use their existing equipment by inserting a productivity module 70 between their first print engine 58 and their one or more finishing devices 62 can be economically attractive since the second print engine 64 of the productivity module 70 does not need to come equipped with the input paper handling drawers coupled to the first print engine 58. Furthermore, the second print engine 64 can be based on the existing technology of the first print engine 58 with control modifications which will be described in more detail below to facilitate synchronization between the first and second print engines.

Figure 4:
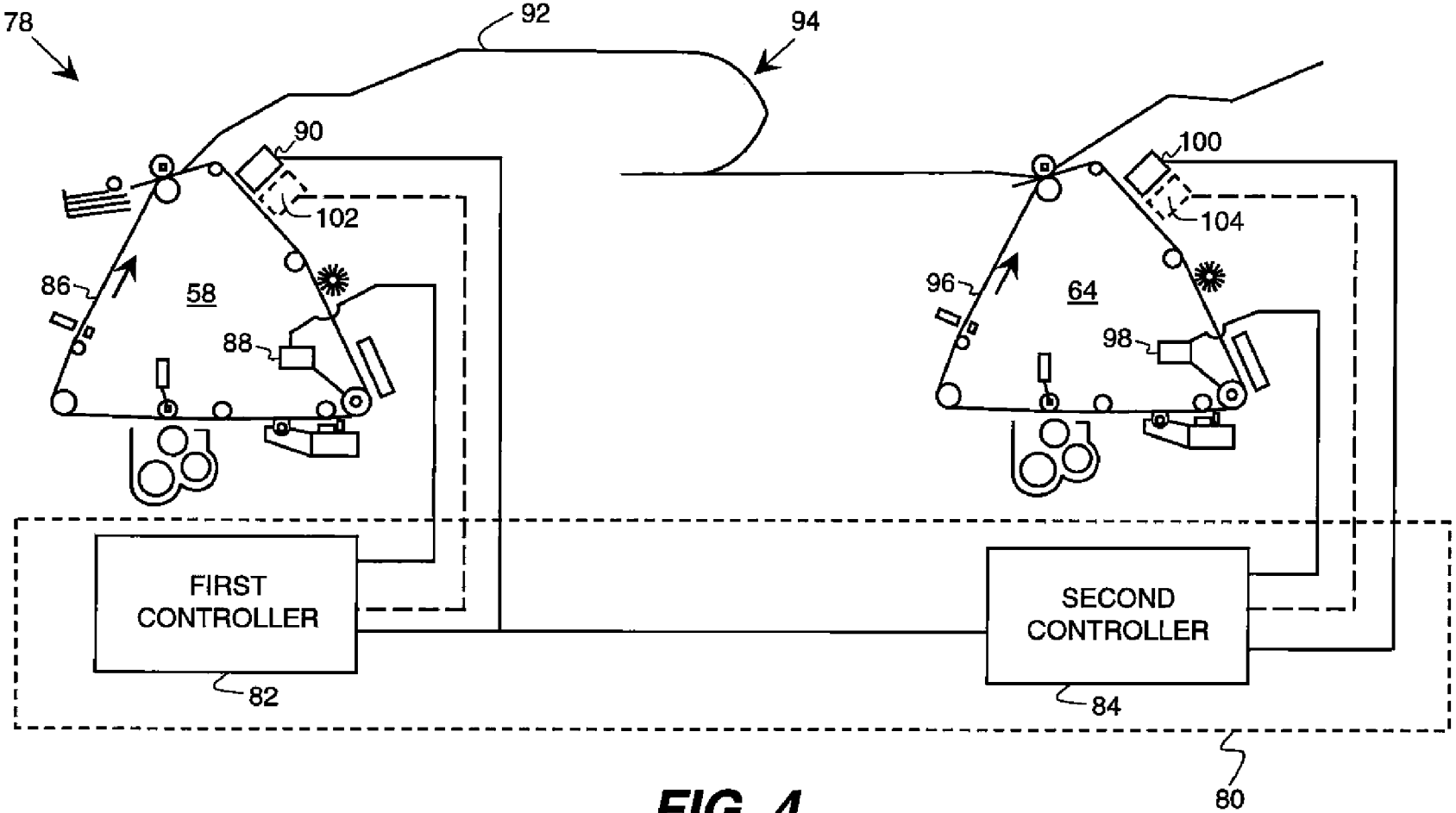
FIG. 4 schematically illustrates an embodiment of a reproduction or printing apparatus of a first and second print engine.

FIG. 4 schematically illustrates an embodiment of a reproduction apparatus 78 having embodiments of first and second print engines 58, 64 which are synchronized by a controller 80. Controller 80 may be a computer, a microprocessor, an application specific integrated circuit, digital circuitry, analog circuitry, or any combination and/or plurality thereof. In this embodiment, the controller 80 includes a first controller 82 and a second controller 84. Optionally, in other embodiments, the controller 80 could be a single controller as indicated by the dashed line for controller 80. The first print engine 58 has a first primary imaging member (PIM) 86, the features of which have been discussed above with regard to the PIM of FIG. 1. The first PIM 86 also preferably has a plurality of frame markers corresponding to a plurality of frames on the PIM 86. In some embodiments, the frame markers may be holes or perforations in the PIM 86 which an optical sensor can detect. In other embodiments, the frame markers may be reflective or diffuse areas on the PIM, which an optical sensor can detect. Other types of frame markers will be apparent to those skilled in the art and are intended to be included within the scope of this specification. The first print engine 58 also has a first motor 88 coupled to the first PIM 86 for moving the first PIM when enabled. As used here, the term "enabled" refers to embodiments where the first motor 88 may be dialed in to one or more desired speeds as opposed to just an on/off operation. Other embodiments, however, may selectively enable the first motor 88 in an on/off fashion or in a pulse-width-modulation fashion.

The first controller 82 is coupled to the first motor 88 and is configured to selectively enable the first motor 88 (for example, by setting the motor for a desired speed, by turning the motor on, and/or by pulse-width-modulating an input to the motor). A first frame sensor 90 is also coupled to the first controller 82 and configured to provide a first frame signal, based on the first PIM's plurality of frame markers, to the first controller 82.

A second print engine 64 is coupled to the first print engine 58, in this embodiment, by a paper path 92 having an inverter 94. The second print engine 64 has a second primary imaging member (PIM) 96, the features of which have been discussed above with regard to the PIM of FIG. 1. The second PIM 96 also preferably has a plurality of frame markers corresponding to a plurality of frames on the PIM 96. In some embodiments, the frame markers may be holes or perforations in the PIM 96, which an optical sensor can detect. In other embodiments, the frame markers may be reflective or diffuse areas on the PIM which an optical sensor can detect. Other types of frame markers will be apparent to those skilled in the art and are intended to be included within the scope of this specification. The second print engine 64 also has a second motor 98 coupled to the second PIM 96 for moving the second PIM 96 when enabled. As used here, the term "enabled" refers to embodiments where the second motor 98 may be dialed in to one or more desired speeds as opposed to just an on/off operation. Other embodiments, however, may selectively enable the second motor 98 in a pulse-width-modulation fashion.

The second controller 84 is coupled to the second motor 98 and is configured to selectively enable the second motor 98 (for example, by setting the motor for a desired speed, or by pulse-width-modulating an input to the motor). A second frame sensor 100 is also coupled to the second controller 84 and configured to provide a second frame signal, based on the second PIM's plurality of frame markers, to the second controller 84. The second controller 84 is also coupled to the first frame sensor 90 either directly as illustrated or indirectly via the first controller 82 which may be configured to pass data from the first frame sensor 90 to the second controller 84.

While the operation of each individual print engine 58 and 64 has been described on its own, the second controller 84 is also configured to synchronize the first and second print engines 58, 64 on a frame-by-frame basis. Optionally, the second controller 84 may also be configured to synchronize a first PIM splice seam from the first PIM 86 with a second PIM splice seam from the second PIM 96. In the embodiments that synchronize the PIM splice seams, the first print engine 58 may have a first splice sensor 102 and the second print engine 64 may have a second splice sensor 104. In other embodiments, the frame sensors 90, 100 may be configured to double as splice sensors.

In order to properly join the modules, it is important that the components including any printing engines and/or modules properly align. These modules could be subcomponents of a printing engine that are movable or additional modules such as an accessory device. For example, components that drive the receiver, such as the photoreceptor, fuser roller, inverter drive system, etc. must all be aligned to within 0.125" or less from the front of the assembled modules to the back without any skew. Failure to do so can result in the paper being driven out of proper tracking within the digital print engine. While alignment can be maintained if all modules are produced in close temporal proximity in a single factory using components that have also been produced in close temporal proximity and location, such alignment cannot be guaranteed if either the time or location of manufacture has varied. This is even more problematic if one is upgrading existing digital print engines by coupling addition modules to them in order to enhance either their features or their productivity. Cross track adjustments in the field are especially problematic in many situations and are accomplished in this invention by using a set of measured points and can be used and/or fine tuned as an estimate for other adjustments both prior to installation and/or after installation of the assembly at the customer's location for the printing assembly. Often the additional adjustments are critical in real printing applications because of the many on-site variability such as uneven floors and environmental variability that, when combined with the manufacturing tolerances that are in any machine, can cause printing problems and efficiency challenges.

U.S. Pat. No. 6,968,606 discloses an apparatus and method of connecting a movable subsystem to a frame. This disclosure differs in that the components being aligned are not aligned to the frame and would not be considered movable. Rather, specific components in separate modules are aligned with respect to one another and, once the digital print engine is assembled, the modules are not expected to be routinely moved. Presently, digital print engines including a plurality of modules are aligned together by mounting the support feet for the modules in a set of long steel tracks. This makes installation in the field difficult, does not readily allow for upgrading existing digital print engines, and does not allow for adjustment to compensate for manufacturing variations of the components.

To align the modules, measurements are taken for each module. In one preferred embodiment, the location relative to the receiver path is determined for each of a number of modules, such as the paper path module or a fuser or toning station or any other fixed module in the printer. Alignment is referenced to this fixed location. Alignment can also be effected using other fixed points such as, for example, a floor or wall. The centerline of the frame would alternately be an acceptable marking. Components such as the edge or center of a photoreceptive web would not be appropriate as this could wander cross-track.

Figure 5:
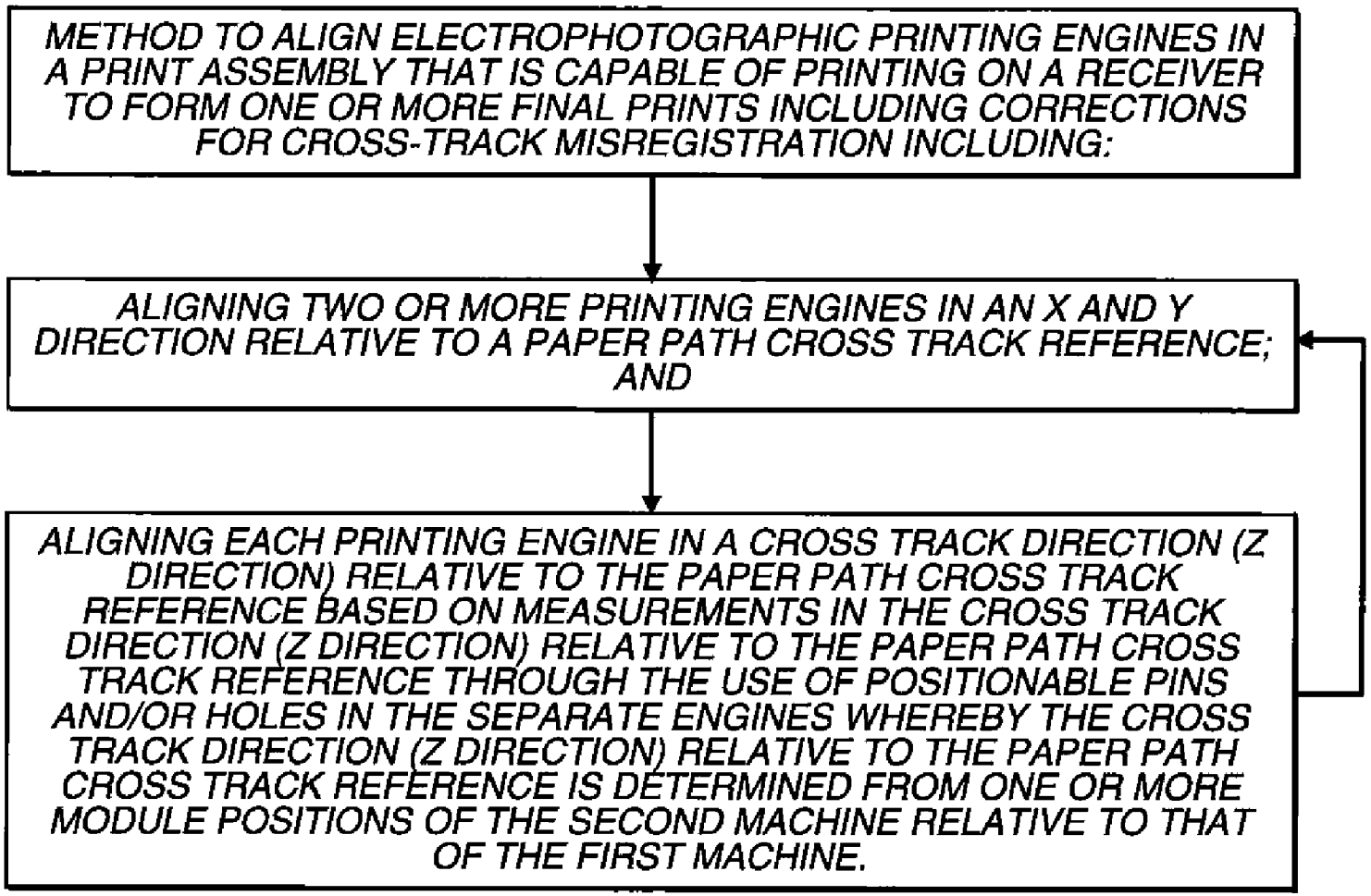
FIG. 5 shows a method of cross track alignment.

To align the printing engines, components such as an alignment pin or an alignment hole into which the pin mates are attached to the mating surfaces of the frames of the respective modules to be mated. FIG. 5 shows one method this would be accomplished using either the pins 100 (see FIG. 3A) or the alignment holes 102 (see FIG. 3A), preferably both, need to be able to be adjusted cross track to the direction of the paper path. While more alignment is preferable, the ability to adjust the total position of the two mating modules with respect to each other by 0.5" generally should suffice. While one set of alignment pins and holes per mating pair of modules generally will suffice, it is preferred to use at least two to minimize errors and maximize rigidity.

This allows components in a factory, for example, to be aligned with a digital print engine that is at a customer site. The location of the pins and holes are then positioned a set distance cross track to the center line of the paper path. To insure that the modules are in vertical alignment, irrespective of variations within the several modules or nonuniformity of the floor in the customer site, measurements are taken along the vertical direction to a marker such as the center axis of a photoreceptive drum, fuser roller, paper path, or other suitable feature of each component and the floor of what will be the location of the module at the customer site. Spacers 104 (See FIG. 3A) are then used to adjust the vertical displacement, or other directions if necessary, of the modules to bring them into what will be proper alignment at the customer site. It is preferable that the spacers be adjustable, as are commonly used on appliances. Proper leveling will not only bring the components into vertical alignment, but will also insure that the modules do not exert a torque on one another. This method is used for cross track adjustments in the field that are based on a set of measured points and can be used and/or fine tuned as an estimate for other adjustments. The additional adjustments are critical in real printing applications because of the many on-site variability such as uneven floors and environmental variability that, when combined with the manufacturing tolerances that are in any machine, can cause printing problems and efficiency challenges.

In one embodiment aligning each printing engines in a cross track direction (z direction) relative to the paper path cross track reference is based on measurements in the cross track direction (z direction) relative to the paper path cross track reference. The alignment is achieved by first measuring the location of specific components or modules in each printing engine of the printing assembly. Alignment pins and holes are then located to correctly horizontally align the components and additional spacers are installed to allow the modules to be aligned vertically. The positions of the alignment pins and/or holes can be adjusted so that the digital print engine can be realigned when necessary such as when components are changed and/or prior to docking.

The cross track direction (z direction) relative to the paper path cross track reference is determined from one or more paper transport devices of the second machine relative to that of the first machine and a receiver type in one embodiment. If helpful additional steps can be added such as printing one or more prints using each of at least two print engines in turn to produce the one or more final prints such that each print engine produces at least one mark to use as a reference mark on a final print, measuring the distance between each of the at least two reference marks laid down during the printing relative to the paper path cross track reference; and fine aligning the two or more printing engines in the cross track direction (z direction) relative to the paper path cross track reference. It is often useful to use cumulative data to calculate an adjustment, such as the average displacement of two reference marks from 10 subsequent prints made after the machine is initiated for printing. These measurements can be automated using the controllers.

Figure 6:
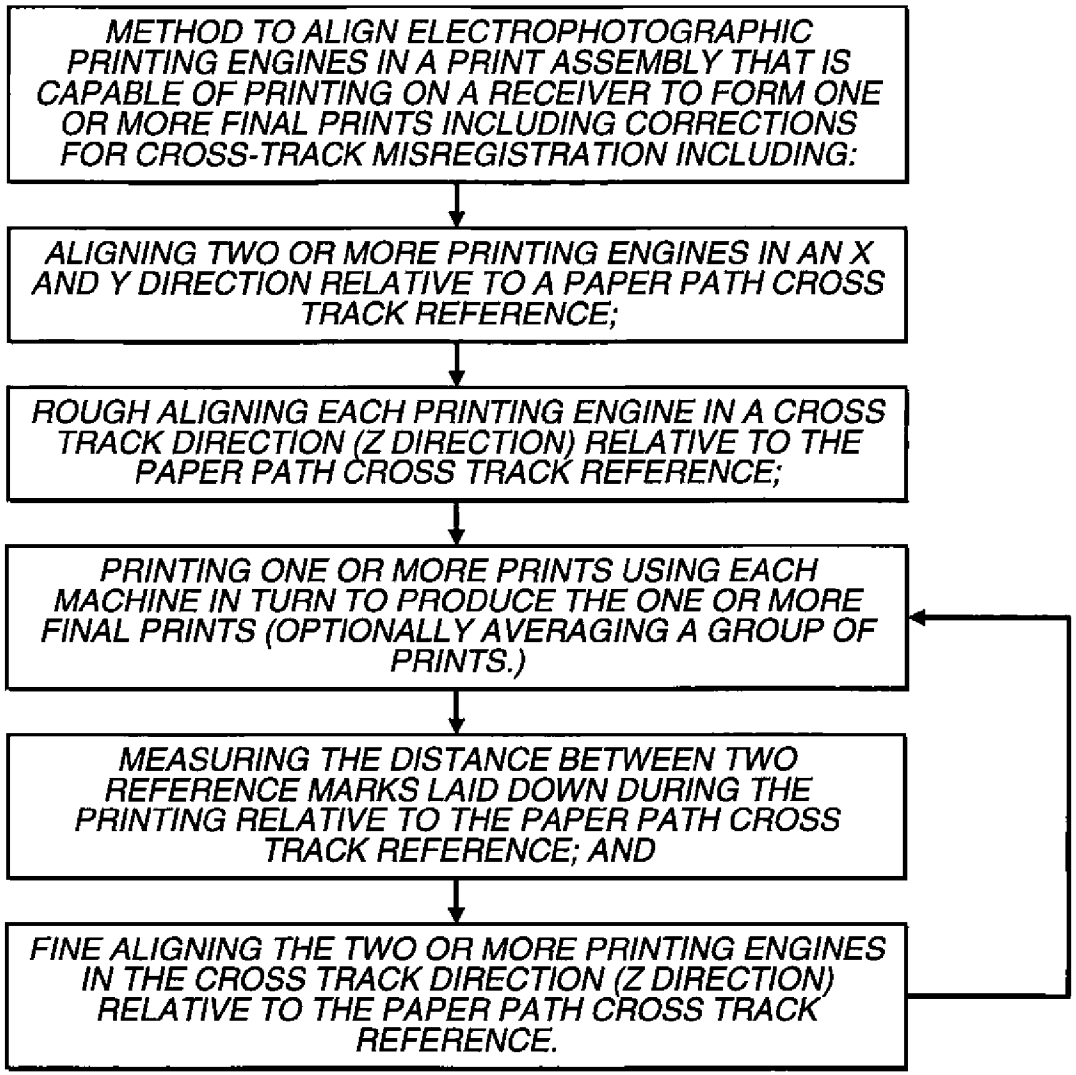
FIG. 6 shows another method of cross track alignment.
Figure 7:
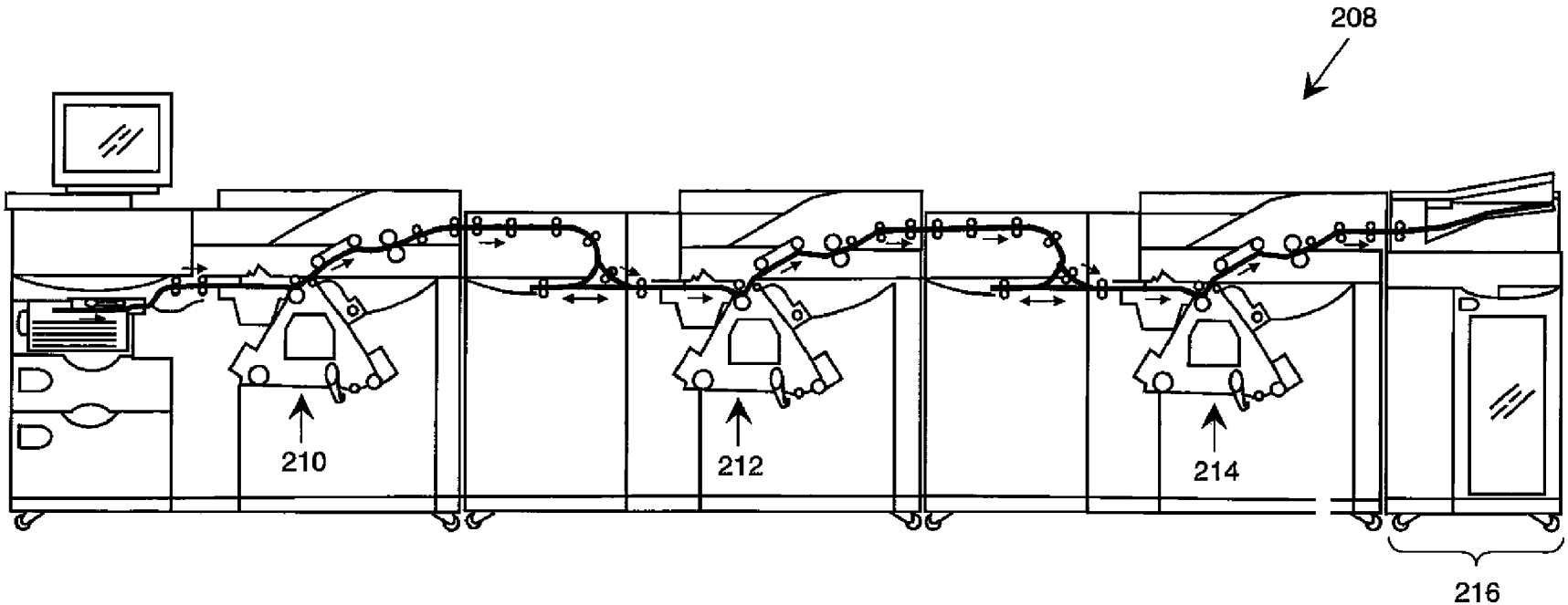
FIG. 7 shows alignment of 3 printing engines.

In one embodiment of practicing this invention, measurements are made, as shown in FIG. 6. FIG. 7 shows that this method can be used for more than 2 printing engines 210 and 212. Three are shown but the third 214 could also include a finishing module 216 or other subcomponents of a printing assembly. The adjustment method aligns printing engines in a print assembly that is capable of printing on a receiver to form one or more final prints and includes corrections for cross-track misregistration. This method is used to align an electrophotographic printing engines in a print assembly that is capable of printing on a receiver to form one or more final prints including corrections for cross-track misregistration includes aligning two or more printing engines in an x and y direction relative to a paper path cross track reference and rough aligning each printing engines using any module, not just the printing engine, in a cross track direction (z direction) relative to the paper path cross track reference by printing one or more prints using each machine in turn to produce the one or more final prints, measuring the distance between two reference marks laid down during the printing relative to the paper path cross track reference and fine aligning the two or more printing engines in the cross track direction (z direction) relative to the paper path cross track reference. This allows the cross track direction (z direction) relative to the paper path cross track reference to be determined from one or more paper transport devices of the second machine relative to that of the first machine and a receiver type. Other devices include the environmental systems, the inverter, the writers, the cleaners, the fusing and toning systems and any accessories. Additional steps can be used that include taking measurements are taken along a vertical direction to a fiducial and a floor at a printing assembly proposed location at a customer site. The adjustments are made in a plurality of ways including using adjustable spacers to bring the printing engines into proper vertical alignment. This allows aligning the printing engines to allow cross track alignment of better than 0.125" in the cross track direction.

Figure 8:
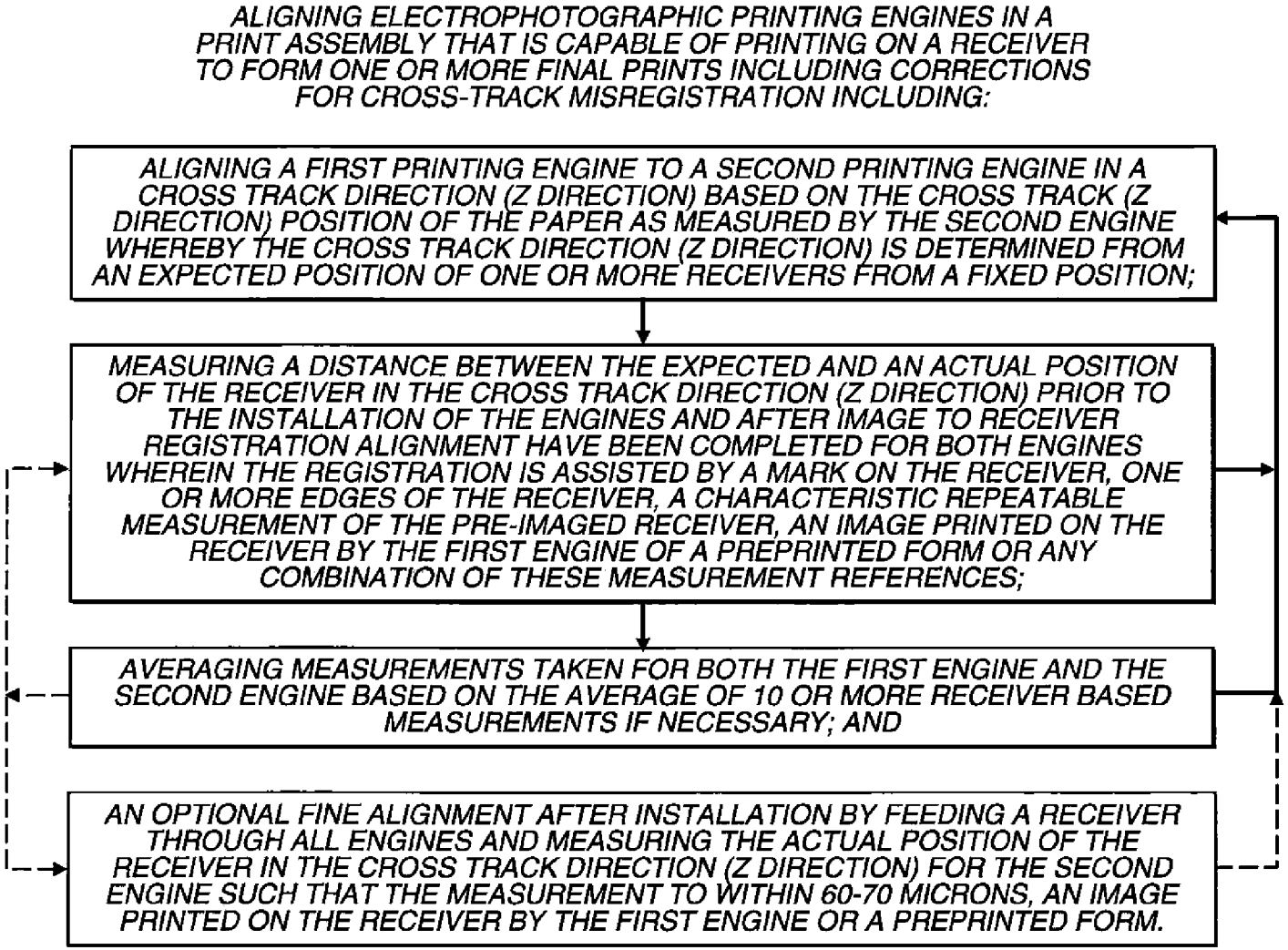
FIG. 8 shows another method of cross track alignment.

One preferred mode of practicing this invention uses one of the engines to be aligned to also measure the information that acts as the reference for the alignment of the two or more printers in the cross track direction, as shown in FIG. 8. This adjustment method aligns printing engines in a print assembly that is capable of printing on a receiver to form one or more final prints and includes corrections for cross-track misregistration including those caused by a misalignment in the cross-track direction (z direction) relative to the measurement made by one of the engines. In this method for cross track alignment of a first printing engine to a second printing engine in the cross track direction (z direction) is based on a cross track (z direction) position of a printed or unprinted receiver, such as a paper, that is measured by the second engine. It is known to those skilled in the art that a first engine could also take the measurements of a characteristic of a receiver and uses that measurement as described above to align the second engine. Furthermore there could be more then two engines that took measurements and used those to align each other in similar manners. In this embodiment the alignment method is assisted by a number of possible characteristics, or two receiver related references; of the receiver and/or print including a mark on paper, one or more edges of the receiver, a repeatable characteristic measurement of the pre-imaged paper, an image printed on the receiver by the first engine. These include a preprinted form or any combination of these measurement references. The cross track direction (z direction) is determined from an expected position of one or more papers from a fixed position such as a roller or entrance of the machine. Additional steps can be used that include taking measurements are taken along a vertical direction to a fiducial and a floor at a printing assembly proposed location at a customer site. The adjustments are made in a plurality of ways including using adjustable spacers to bring the printing engines into proper vertical alignment. This allows aligning the printing engines to allow cross track alignment of better than 0.125" in the cross track direction. The receiver position measurement are in certain circumstances taken for both the first engine and the second engine based on the average of a number of receiver pass through, such as more then two, and probably 10 to 25 or more.

In one example this method is performed prior to the installation of the engines. This can even be done during manufacturing using a printed image after image to paper registration alignment have been completed for both engines. In this example one engine prints an image and the position of the paper in the second engine is compared to the expected position of the paper at the registration point. This comparison is done to within 60-70 microns normally.

An alignment system that allows the aligning described above uses the printing assembly itself including a plurality of electrophotographic printing engines in a print assembly that is capable of printing on a receiver to form one or more final prints wherein the print engines are alignable in an x, y and z direction relative to a paper path cross track reference wherein the paper path cross track reference is based on measurements in the cross track direction (z direction) relative to the paper path cross track reference that print one or more prints using each of at least two print engines in turn to produce the one or more final prints such that each print engine produces at least one mark to use as a reference mark on a final print as well as a measurement device to measure the distance between each of the at least two reference marks laid down during the printing relative to the paper path cross track reference and an alignment device to align the two or more printing engines in the cross track direction (z direction) relative to the paper path cross track reference. Alignment devices also include alignment pins on at least one side of a first print engine module and alignment holes on at least one side of a second module whereby alignment pins on the first module fit into the alignment holes in the second module and/or one or more guides, such as printed fiducials and/or spacers to allow cross track alignment of better than 0.125".

The invention has been described in detail with particular reference to certain preferred embodiments thereof, but it will be understood that variations and modifications can be effected within the spirit and scope of the invention.

What is claimed is:

1. A method to align an electrophotographic printing engines in a plurality of different print assemblies that are each capable of printing on a receiver to form one or more final prints to form an apparatus for digital printing including corrections for cross-track misregistration comprising:

measuring each of the print assemblies to determine the location of a fixed component of the module relative to a receiver path in the x, y and z directions;

aligning two or more printing engines in an x and y direction by providing alignment features on the printing assemblies that align the assemblies in an x and y direction according to the measurements and that positioning the assemblies within a range of positions along the z direction;

aligning a first printing engine to a second printing engine in a cross track direction (z direction) based on a cross track (z direction) position of the receiver as measured by the second engine and the measuring of the printing modules.

2. The method according to claim 1 whereby alignment of the plurality of machines is effected prior to docking.

3. The method according to claim 1 whereby alignment is achieved through the use of positionable pins and/or holes in the separate engines.

4. The method according to claim 1 whereby the cross track direction (z direction) is determined from an expected position of one or more receivers from a fixed position.

5. The method according to claim 1 further comprising the second engine measuring a distance between the expected and an actual position of the receiver in the cross track direction (z direction).

6. The method according to claim 1 further comprising measuring an expected and an actual position of the receiver in the cross track direction (z direction) prior to the installation of the engines and after image to receiver registration alignment have been completed for both engines.

7. The method according to claim 6 further comprising a fine alignment after installation by feeding a receiver through all engines and measuring the actual position of the receiver in the cross track direction (z direction) for the second engine.

8. The method according to claim 1 further comprising measurement to within 60-70 microns.

9. The method according to claim 1 wherein the measurements can be done using one or more of a mark on the receiver, one or more edges of the receiver, a repeatable characteristic of the receiver, an image printed on the receiver by the first engine or a preprinted form.

10. The method according to claim 1 wherein the receiver position measurement is taken for both the first engine and the second engine based on the average of 10 or more receiver based measurements.

11. The method according to claim 10 wherein the receiver position measurements are such that they independently indicate the required cross track adjustment for each of if the first and second engine.

12. An apparatus for digitally printing comprising:

a plurality of electrophotographic printing engines each in one of two or more of different print assemblies that are capable of printing on a receiver to form one or more final prints wherein the print engines are alignable in an x, y and z direction relative to a receiver path cross track reference for sequentially printing on a receiver wherein the receiver path cross track reference is based on measurements in the cross track direction (z direction) relative to the receiver path cross track reference;

a measurement device to measure a location of a receiver in the receiver path at a final one of the sequence of print assemblies; and an alignment device to align the two or more printing engines in the cross track direction (z direction) relative to the receiver path cross track reference based on the measurement.

13. The apparatus of claim 12, the alignment device further comprising:

alignment pins on at least one side of a first print engine module; and alignment holes on at least one side of a second module whereby alignment pins on the first module fit into the alignment holes in the second module.

14. The apparatus of claim 12, further comprising one or more guides to allow cross track alignment of better than 0.125".

15. The apparatus of claim 14, the guides further comprising one or more chosen fiducials.

16. The apparatus according to claim 12 whereby at least one print engine comprises an electrophotographic print engine.

17. The apparatus according to claim 12 whereby the digital print engine assembly comprises a plurality of electrophotographic print engines.

18. The apparatus according to claim 12 comprising an inverter.

19. The apparatus according to claim 12, the adjuster device comprising pins and holes to adjust in a front-to-back direction whereby one of the pins and/or holes is adjusted.

20. The apparatus according to claim 12 further comprising spacers for leveling the print engines.

* * * * *